United States Patent [19]

Taylor et al.

[11] Patent Number: 4,850,329

[45] Date of Patent: Jul. 25, 1989

[54] FIRING MECHANISMS FOR AIR WEAPONS

[75] Inventors: Hugh F. Taylor, Sawston; David R. Theobald, St. Ives, both of England; Derek J. C. Bernard, Channel Islands, Great Britain

[73] Assignee: UTEC B.V., Driebergen, Netherlands

[21] Appl. No.: 142,137

[22] Filed: Jan. 11, 1988

[30] Foreign Application Priority Data

Jan. 9, 1987 [GB] United Kingdom ..... 8700423
Apr. 6, 1987 [GB] United Kingdom ..... 8708206

[51] Int. Cl.[4] ..... F41B 11/00

[52] U.S. Cl. ..... 124/68; 124/66; 124/67

[58] Field of Search ..... 124/63–68

[56] References Cited

U.S. PATENT DOCUMENTS 4,038,961 8/1977 Olofsson ..... 124/68 X
4,369,759 1/1983 Gerstenberger et al. ..... 124/68

FOREIGN PATENT DOCUMENTS 2557625 6/1977 Fed. Rep. of Germany ..... 124/68
428696 3/1980 U.S.S.R. ..... 124/68
1604456 12/1981 United Kingdom ..... 124/68
2084704 4/1982 United Kingdom ..... 124/65
217328712 10/1986 United Kingdom .

*Primary Examiner*—Randolph A. Reese
*Assistant Examiner*—John Ricci
*Attorney, Agent, or Firm*—Lee & Smith

[57] ABSTRACT

A firing mechanism for an air weapon in which air is compressed in a cylinder and expelled through a discharge port in the cylinder to propel a projectile along a barrel by a piston executing a firing stroke. The mechanism comprises a piston slidably located within a cylinder with the crown of the piston facing towards the discharge port. A spring urges the piston towards the discharge port. A bobbin is located behind the piston crown, which is axially movable with the piston during at least a portion of the firing stroke and is axially movable relative to the piston at the end of the firing stroke.

19 Claims, 3 Drawing Sheets

FIRING MECHANISMS FOR AIR WEAPONS

BACKGROUND OF THE INVENTION

The present invention relates to firing mechanisms for air weapons and to air weapons incorporating such firing mechanisms.

Many air weapons use a system of stored energy in which a spring, typically either a metallic coil spring or a sealed gas charge as described in GB No. 2,084,704 B, is compressed and retained in a compressed condition by a trigger mechanism prior to firing. When the trigger is operated the spring is released and drives a piston along a cylinder, compressing the air ahead of it, forcing the air through a transfer port and then through a barrel, carrying a projectile, typically a pellet, ahead of it.

The piston and spring assembly (or assemblies in the case of opposed piston configurations) will usually weigh several hundred grammes and will travel at very high speed. The assembly therefore has a considerable amount of kinetic energy at the end of the firing stroke.

Ideally, all the kinetic energy would be transferred to the projectile but, in practice, this is extremely difficult to achieve.

Typically, in the process of coming to rest, the piston assembly will bounce off the end of the cylinder or off a layer of highly-compressed air between it and the end of the cylinder. This bouncing action not only consumes some of the kinetic energy but is a major source of disturbance to the air weapon as a whole and is thus a cause of inaccuracy.

This problem has been very widely recognised for a very long time and many attempts have been made to overcome piston bounce. GB No. 1,604,456 and GB 2,173,287A are examples of earlier work towards this end.

SUMMARY OF THE INVENTION

It is an object of the present invention to substantially eliminate piston bounce at the end of a piston firing stroke. Reduction in piston bounce will enhance both accuracy and comfort when firing the weapon.

It is a further object to provide such an improved firing mechanism that can be incorporated in an existing weapon.

According to the invention there is provided a firing mechanism for an air weapon in which air is compressed in a cylinder and expelled through a discharge port in the cylinder to propel a projectile along a barrel, by a piston executing a firing stroke, the mechanism comprising a piston slidably located within a cylinder with the crown of the piston facing towards the discharge port, spring means urging the piston towards the discharge port, and a mass located behind the piston crown, the mass being axially movable in the same direction as the piston during at least a portion of the firing stroke and being axially movable relative to the piston when the piston reaches the end of its travel within the cylinder towards the discharge port.

The mass may travel with the piston during the firing stroke, though not necessarily at the same speed, and movement of the piston and mass need not necessarily begin simultaneously.

The mass may be normally located at a position rearwardly from the inside face of the piston crown prior to firing, perhaps under the pressure of a light spring located between the piston crown and the mass. Alternatively a gap between the inside of the piston crown and the mass may be created during the firing stroke by arranging for the piston to accelerate faster than the mass.

In all configurations a gap will exist between the rear of the piston crown and the mass at the instant that the piston comes to an abrupt stop at the end of the firing stroke. The mass will continue to travel forwards under its own inertia and, if the correct design parameters have been chosen, will reach the rear of the piston crown just as the piston is starting to bounce backwards. The momentum of the mass will substantially prevent the bounce taking place and will, in effect, keep the piston closely adjacent to the end face of the compression chamber while the highly compressed air between the piston crown and the end face of the compression chamber flows to and through the transfer port.

The piston may include a piston skirt extending rearwardly from the piston crown, and the mass is preferably constituted by a bobbin which may be constrained to move within at least a portion of the volume within the piston skirt. There may be annular spacers around the periphery of the bobbin which space the bobbin from the inner wall of the piston skirt. Preferably, the bobbin is formed with at least one generally longitudinally extending conduit. The bobbin may be slidably mounted on a shaft extending axially along the centre of the piston.

Such a shaft may be formed with a collar which limits the rearward movement of the bobbin along the shaft. Preferably, biasing means urges the mass either towards the rear of the piston crown or the collar. There may be cushioning means between the bobbin and the rear of the piston crown, which may be in the form of an 0-ring or other resilient inserts in either or both piston or bobbin. There may be cushioning means on a face of the bobbin adjacent the end of the piston towards which the bobbin is urged by the biasing means, which may be in the form of an O-ring.

The biasing means for the mass may be a coil spring which bears against an inner face of the piston crown and an adjacent face of the bobbin. Alternatively, the coil spring may bear against an abutment towards the end of the piston skirt remote from the piston crown and adjacent face of the bobbin.

In other embodiments, the means for urging the piston towards the transfer port is a gas spring assembly as is shown, for example, in GB No. 2,084,704B. In this construction a dummy piston is fixedly secured relative to the compression cylinder which sealingly and slidingly engages the internal surface of the piston skirt to define a sealed compressible charge chamber. Of course, other similar arrangements exist in which the dummy piston is not fixedly secured relative to the compression cylinder, since the latter may move relative to the dummy piston, for example, during cocking.

In such gas spring arrangements the mass is preferably constituted by a bobbin which is constrained to move within at least a portion of the volume within the piston skirt. There may be annular spacers around the periphery of the bobbin which space the bobbin from the inner wall of the piston skirt. Means must be provided for gas to flow from either side of the bobbin to the other in a controlled manner and so such a bobbin is preferably formed with at least one generally longitudinally extending conduit to achieve this.

It is believed that consistent operating results are more likely to be achieved if the mass is automatically and consistently located in the same position relative to the inside of the piston crown at the start of each firing stroke. Thus, in the gas spring assembly described above the bobbin will be consistently positioned towards the piston crown end of the inner space of the piston by the relative movement of the dummy piston into the piston during the cocking stroke.

In other configurations, the biasing means for moving the mass consistently into the same position relative to the piston crown prior to firing may consist of a light coil spring which bears against an inner face of the piston crown and an adjacent face of the bobbin. Alternatively, the coil spring may bear against an abutment located behind the bobbin and the adjacent face of the bobbin.

An alternative and very common means for urging the piston towards the transfer port may be a coil spring. In such a case, the mass may either be contained within a space (which may be sealed) within an enlarged piston assembly and, in the case of a bobbin, may be slidably mounted on a shaft extending axially along the centre line of the piston.

In cases where the mass is located within an enclosed space within the piston assembly, the mass may be in the form of a bobbin or possibly heavy granules such as steel shot or a heavy liquid such as mercury.

The invention also extends to an air weapon incorporating a firing mechanism as defined above.

The invention may be carried into practice in various ways and some embodiments will now be described by way of example with reference to the accompanying drawings.

DESCRIPTION OF THE PREFERRED EMBODIMENTS

Figure 3:
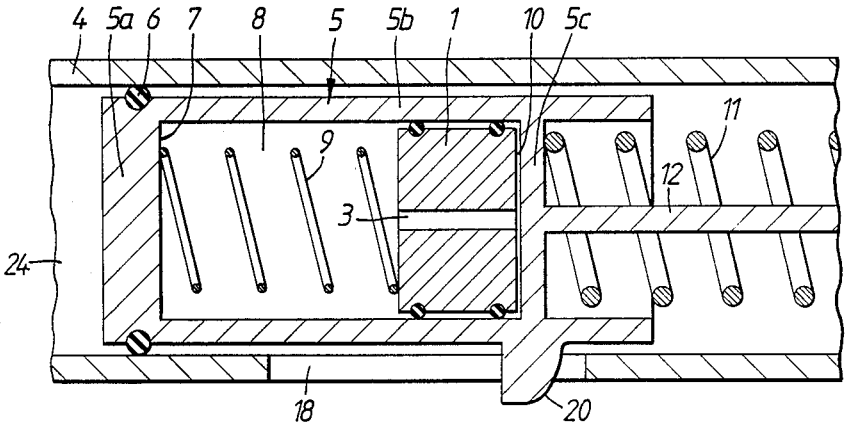
FIG. 3 is a cross-sectional side elevation of a mechanical spring type firing mechanism for an air weapon incorporating the bobbin-type body of FIG. 1 in a first embodiment of the invention.

Referring firstly to FIG. 3, this shows part of a firing mechanism for an air gun. Such a piston assembly could be incorporated into air guns with either coil or gas springs but is shown with a coil spring in this first embodiment. The mechanism comprises a compression cylinder 4 and a piston 5 acting inside the cylinder. An O-ring seal 6 is accommodated in a groove in the piston crown **5*a* and forms a seal between the inner surface of the cylinder 4 and the outer surface of the piston 5**.

A piston skirt **5*b* extends axially behind the piston crown 5*a*. Most of the internal volume behind the piston crown 5*a* within the piston skirt 5*b* is closed off to form a closed space 8 by a recessed end plate 5*c*. One end of a main helical firing spring 11 bears against the face of the end plate 5*c* which is remote from the piston crown 5*a*. The other end of the main spring 11 bears against a wall (not shown). A trigger rod 12 extends axially from the end plate 5*c* to engage the trigger mechanism (not shown) as the piston 5 is retracted to a cocked position and the spring 11** is compressed.

Within the closed space 8 of the piston 5, there is a steel body or thick disc in the form of a bobbin. The bobbin is circular in section and has a central longitudinal hole 3. At each end of the bobbin, there is an annular groove in its outer surface; each groove receives an O-ring 2. The bobbin 1 can move axially with respect to the piston 5 against the force of an auxiliary coil spring 9 which bears against an inner face 7 of the piston crown **5*a* to urge the bobbin 1 towards the end plate 5*c* so that the gap between the bobbin and the end plate 5*c* is minimum. The O-rings 2 engage the internal surface of the closed space 8** to space the bobbin from the internal surface and provide a sliding seal.

The piston 5 is formed with a radially extending lug 20 which extends through a slot 18 in the wall of the cylinder 4. When the gun is fired, the piston 5 is released and is forced forward by the spring 11. The piston 5 compresses the air in the cylinder and the air is expelled through a transfer port (not shown).

When the piston 5 is released from the cocked position, the bobbin 1 is carried forward with it at the same speed. The motion of the piston 5 comes to an abrupt halt after travelling at high speed along the cylinder 4, when it reaches the end of the compression chamber 24. However, the bobbin 1 will continue to travel in the same direction at high speed due to its inertia, but also relative now to the piston 5, against the force of the auxiliary spring 9. As the bobbin 1 moves along the piston 5, the gas in front of the bobbin 1 is displaced through the central hole 3.

When the piston 5 has reached the end of its stroke it will begin to rebound off the front end wall (not shown) of the cylinder 4 or the small cushion of gas caught between the piston 5 and the front end wall. At this point, the bobbin 1, now travelling relatively to the piston 5, arrives at the inner surface of the piston crown and impacts the inner face 7 of the piston crown delivering its accumulated kinetic energy to the piston 5.

For any particular firing mechanism, there will be a mass for the bobbin 1 which will cause the bobbin 1 to deliver enough kinetic energy to the piston 5 to suppress effectively the rebounding movement of the piston. Clearly, this will substantially eliminate the jarring sensation which leads to inaccurate shooting. The improvement is particularly noticeable in high powered air rifles. The speed with which the bobbin 1 travels is also clearly a significant factor. This can be adjusted by varying the size of the hole 3, the tightness of the fit of the bobbin 1 in the piston 5 and the rate of the spring 9, amongst other variables.

In a similar embodiment to that described above, the auxiliary spring 9 is omitted and the bobbin 1 is free to move in the space 8.

In this case, if the bobbin 1 is not up against the end plate 5c, at the time of firing it will remain substantially static until the space between the bobbin 1 and the end plate is minimised. It will then be carried with the piston in the manner described above and will effectively suppress the rebound in the same manner.

As an alternative, the mass, constituted by a bobbin in the description above, can be in the form of substantially non-deformable granules of a heavy material, e.g. steel shot, housed inside the piston assembly e.g. in the space 8.

As a further alternative, a heavy liquid, such as mercury, may be used as the mass, in such a case, the liquid would also be contained e.g. within the space 8.

In both these alternative forms of mass, the materials are clearly able to move axially with respect to the piston. Their inertia will ensure that they rapidly take up a position at the rear of e.g. the space 8 during the initial stages of the firing stroke and then continue forward and impinge on the inner face of the piston crown when the piston comes to an abrupt halt at the end of its travel.

Figure 4:
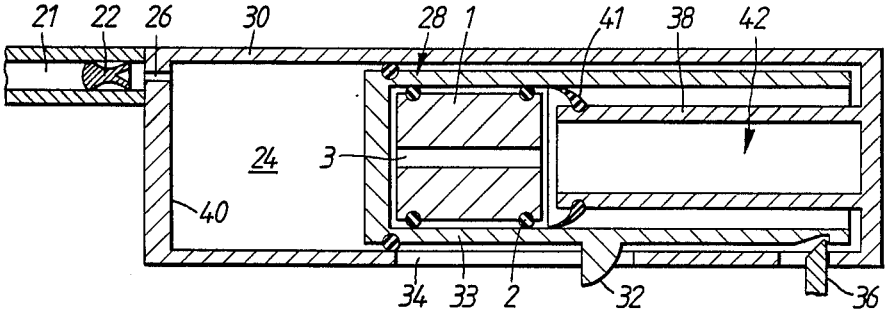
FIG. 4 is a simplified cross-sectional side elevation of a gas-spring firing mechanism for an air weapon, in the cocked condition incorporating a second embodiment of the invention.
Figure 5:
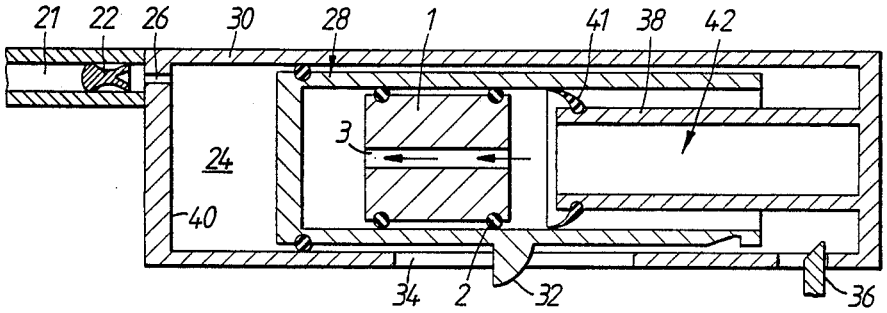
FIG. 5 illustrates the mechanism of FIG. 4 showing the piston assembly half-way through a firing stroke.
Figure 6:
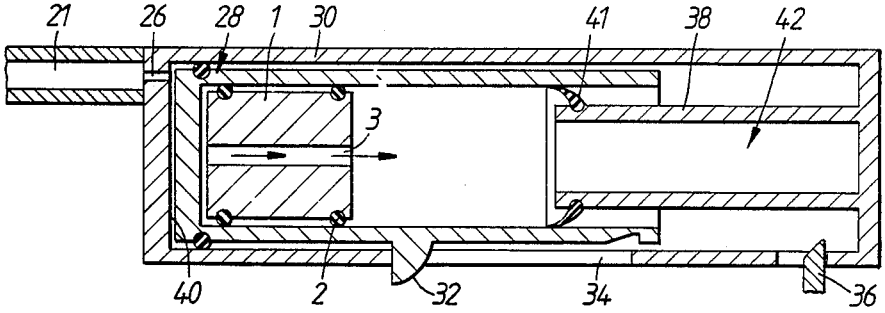
FIG. 6 illustrates the mechanism of FIG. 4 showing the piston and the bobbin-type body at the end of the firing stroke.

Turning now to FIGS. 4, 5 and 6, a second embodiment of the invention s shown in the form of a gas-spring type firing mechanism of the type described in British Patent No. 2084704B.

In this second embodiment a barrel 21 containing a pellet 22 is connected to a compression chamber 24 by a transfer port 26.

As in the case of the first embodiment, a piston 28 travels within a cylinder 30 defining the chamber 24. This piston 28 is cocked by a lug 32 radially extending from a piston skirt portion 33 of the piston 28 through a slot 34 in the cylinder wall. A trigger latch 36 engages a recess the piston skirt 33, to retain the piston 28 in the cocked position.

Figure 1:
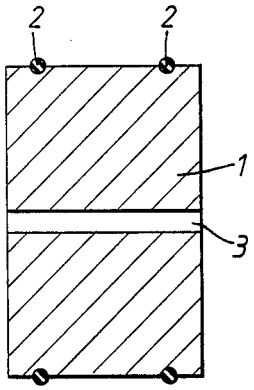
FIG. 1 is a cross-sectional side elevation of a bobbin type body for use in some embodiments of the invention.
Figure 2:
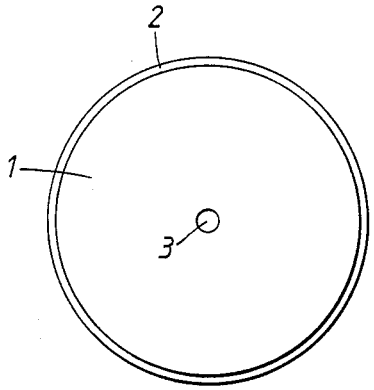
FIG. 2 is an end view of the bobbin-type body in FIG. 1.

A bobbin 1, similar to that in FIGS. 1 and 2, is located within the piston skirt 33. Again, the bobbin is provided with an O-ring seal 2 at each end, each being seated in a corresponding annular groove in the surface of the bobbin 1. A central longitudinal hole 3 is formed in the bobbin 1.

A dummy piston 38 extends axially into the interior of the cylinder 30 from an end wall 40 of the cylinder remote from the transfer port 26. An annular lip seal 41 on the outer periphery of the dummy piston 38 remote from the end wall 40 engages the inner surface of the piston skirt 33 to form a sealed space 42 including the inner volumes of the piston 28 and dummy piston 38. The space 42 is filled with a compressible charge of gas under pressure.

As the piston 28 is cocked, the volume in the space 42 reduces, substantially increasing the pressure therein. The dummy piston 38 protruding within the piston skirt 33 causes the bobbin 1 to be consistently located at the piston crown-end of the space 42 whenever the air gun is cocked.

When the trigger mechanism is actuated to release the piston 28, the increased pressure of the gas contained within the piston skirt 33 and dummy piston 38 forces the piston 28 forwards to compress the air within the compression chamber 24.

As the piston 28 reaches the end of the firing stroke, some of the air in the compression chamber 24 will have been expelled through the transfer port 26 and may well have started moving the pellet 22 down the barrel 21. The remaining air in chamber 24 at the moment the piston 28 reaches the end of its stroke will be in a thin layer at very high pressure.

As the piston 28 accelerates rapidly forwards, the bobbin 1 will accelerate less rapidly as some of the expanding gas passes through hole 3. Hence the bobbin 1 actually moves relative to the piston 28 and a gap is created between the bobbin 1 and the inside face of the piston crown. The acceleration of the bobbin 1 is thus dependent upon the size of the hole 3 and the amount of friction which exists between the internal wall of the piston skirt 33 and the O-rings 2 on the bobbin 1 as well as the inertia of the bobbin 1.

When the piston 28 reaches the end of the firing stroke, some of the air in the compression chamber 24 will have been expelled through the transfer port 26 and may well have started moving the pellet 22 down the barrel 21. The remaining air in chamber 24 at the moment the piston 28 reaches the end of its stroke will be in a thin layer at very high pressure. At this point the direction of travel of the piston 28 reverses abruptly while the bobbin 1 is still travelling towards the piston crown. As the piston 28 actually bounces off the end of the compression chamber or off the thin layer of high pressure air, the bobbin 1 is designed to reach the inner face of the piston crown and to transfer its kinetic energy to the piston 28 in the reverse direction. This substantially suppresses the magnitude of the bounce and ensures that more of the remaining highly compressed air in the compression chamber 24 is forced through the transfer port 26 to assist in propelling the pellet 25.

Figure 7:
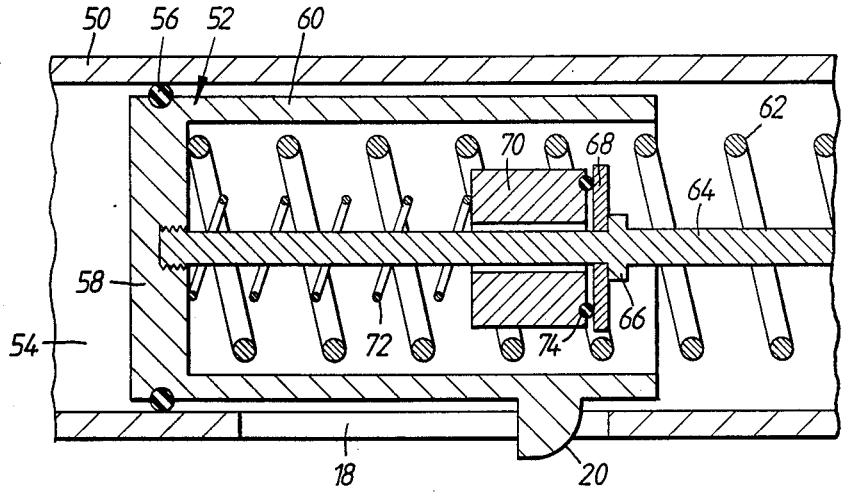
FIG. 7 is a cross-sectional side elevation of a mechanical spring type firing mechanism incorporating a third embodiment of the invention.

In one example of a gas spring firing mechanism incorporating the present invention a piston weighing approximately 300 grammes was used with a bobbin weighing 70 grammes. The hole through the bobbin was 3.2 millimeters in diameter FIG. 7 shows a third embodiment of the invention. This embodiment can be applied to an existing air weapon firing mechanism without changing either the piston or main spring. Thus, the overall length of the action and the size of the spring that can be contained in a given size of weapon are unchanged, with clear consequential benefits in terms of reduced component changes, simplicity and minimal cost.

In this third embodiment, a cylinder 50 has a conventional piston 52 located inside it. To the left of the piston, as seen in the drawing, there is a compression chamber 54. An 0-ring seal 56 on the outer periphery of the piston crown 58 of the piston 52 seals against the inner wall of the cylinder 50. A piston skirt 60 extends behind the piston 52 to define an interior space and is provided with a cocking lug 20. The main firing spring 62 bears against the inner face of the piston crown 58 to urge the piston 52 to the left in order to expel the gas from the compression chamber 54 through a transfer port (not shown) when the piston 52 is released.

A trigger shaft 64 extends axially from the inner face of the piston crown 58 through the main firing spring 62. A trigger mechanism (not shown) will engage the shaft 64 to retain the piston 52 in the cocked position.

The shaft 64 is also formed with a collar 66 to which a stop flange 68 is secured. A bobbin 70 is mounted on the shaft by means of an axial hole through which the shaft extends. The bobbin 70 is urged to the right, as depicted in the drawing against the flange 68 by means of an auxiliary spring 72 which bears against the inner face of the piston crown 58. An 0-ring 74 is located in a channel in the end face of the bobbin 70 adjacent the stop flange 68. The purpose of the 0-ring 74 is to cushion the impact of the bobbin 70 on the flange 68.

As the piston 52 is released on a firing stroke, the bobbin 70 will travel with it. When the piston reaches the end of the firing stroke, it comes to an abrupt halt. Before the piston is able to bounce back, the bobbin 70 travelling in the direction of the firing stroke transmits its kinetic energy to the piston 52. The mass of the bobbin 70 is chosen so that the piston bounce will be substantially suppressed as before.

Once the kinetic energy of the bobbin 70 is absorbed by the piston 58, the influence of the spring 72 will return it to the initial position adjacent the flanges 68.

Figure 8:
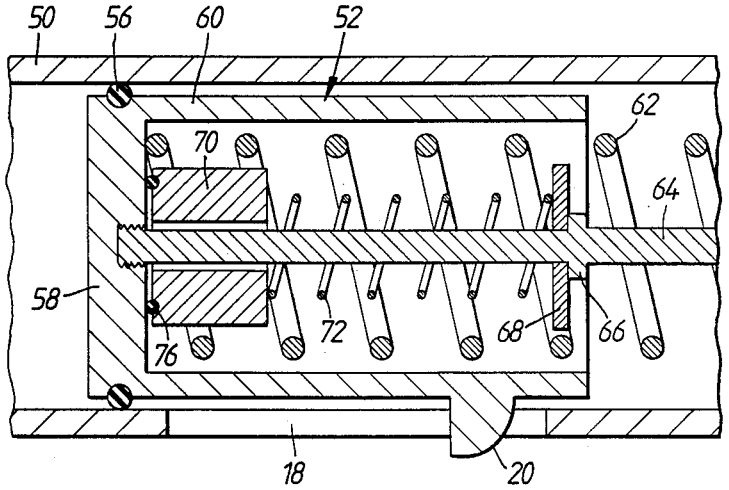
FIG. 8 is a cross-sectional side elevation of a mechanical spring type firing mechanism incorporating a fourth embodiment of the invention.

A fourth embodiment of the invention illustrated in FIG. 8 is similar in most respects to the embodiment of FIG. 7 except the auxiliary spring 72 is located between the bobbin 1 and the stop flange 68. Clearly, in this embodiment the bobbin 70 will be urged by the auxiliary spring 72 towards the inner face of the piston crown whenever the piston 52 is at rest.

When the piston 52 executes a firing stroke it accelerates rapidly to the left and the bobbin 70 remains substantially static until the relatively travelling flange 68, attached to the piston 52 by the shaft 64, has compressed the auxiliary spring 72 sufficiently to overcome the inertia of the bobbin. The bobbin 70 is then carried forwards at substantially the same speed as the piston 52.

When the piston 52 stops abruptly at the end of its firing stroke, the bobbin 70 will continue in the same direction until it strikes the inside face of the piston crown 58. Again, the tendency of the piston 52 to rebound at the end of its stroke is countered by the kinetic energy of the bobbin.

An O-ring 76 is located in a circular channel in the end face of the bobbin 70 adjacent the inner face of the piston crown 58 to cushion the impact between the piston 52 and bobbin 70.

In each of the last two embodiments, the only significant alterations needed to a conventional spring-operated weapon would be the bobbin or inertia piston body assembly, itself, the light coil spring and means to limit the travel of the bobbin such as the flange 68.

As long as the mass of the bobbin and the resistance to its movement (due to the size of aperture and the friction between the bobbin 70 and either the inner wall of the piston skirt 60 or the trigger shaft 64) are chosen carefully it is found that substantial reductions in perceived jarring and recoil as well as increases in the efficiency of air weapons are possible relative to similar weapons not employing the present invention.

Furthermore, it should be understood that the trigger mechanism illustrated in the last two embodiments could be replaced by a trigger mechanism as shown in the embodiment of FIGS. 4 to 6.

Modifications to the bobbin described above include the provision of more than one hole through which gas can pass as the bobbin moves relative to the piston. Alternatively, the holes themselves in the bobbin can, in some cases, be dispensed with if the gas is allowed to pass between the periphery of the bobbin and the wall of the cylinder through, for example, channels let into the bobbin outer surface.

Obviously, numerous modifications and variations of the present invention are possible in the light of the above teachings. It is therefore to be understood that within the scope of the appended claims, the invention may be practiced otherwise than as specifically described herein.

What is claimed as new and desired to be secured by Letters Patent of the United States is:

1. In an air weapon in which air is compressed in a cylinder and expelled through a discharge port in the cylinder to propel a projectile along a barrel by a piston executing a firing stroke, a firing mechanism comprising:

a cylinder having a discharge port;

a piston slidably located within said cylinder, said piston having a crown facing towards said discharge port;

spring means urging said piston towards said discharge port; and a mass located behind said piston crown, said mass being axially movable in the same direction as said piston during at least a portion of said firing stroke and being axially movable relative to said piston when said piston reaches the end of its travel within said cylinder towards said discharge port.

2. A mechanism according to claim 1, wherein said piston includes a piston skirt extending rearwardly from said piston crown, and said mass is constituted by a bobbin which is constrained to move within at least a portion of the volume within said piston skirt.

3. A mechanism according to claim 2 including annular spacers around the periphery of said bobbin which space said bobbin from the inner wall of said piston skirt.

4. A mechanism according to claim 2, wherein said bobbin is formed with at least one generally longitudinally extending conduit.

5. A mechanism according to claim 4 wherein said conduit is a central hole running through said bobbin.

6. A mechanism according to claim 4 wherein said conduit is a channel running along the periphery of said bobbin.

7. A mechanism according to claim 4 wherein said bobbin is slidably mounted on a shaft extending axially along the centre of said piston.

8. A mechanism according to claim 7 wherein said shaft is formed with a collar which limits rearward movement of said bobbin along said shaft.

9. A mechanism according to claim 2 wherein said means for urging said piston towards said discharge port is a gas spring assembly comprising a dummy piston which sealingly and slidingly engages the internal surface of said piston skirt to define a sealed compressible charge chamber.

10. A mechanism according to claim 1, further comprising biasing means urging said mass towards one end of said piston.

11. A mechanism according to claim 1, including cushioning means on a face of said bobbin adjacent the end of said piston towards which said bobbin is urged by said biasing means.

12. A mechanism according to claim 10, wherein said cushioning means is an O-ring.

13. A mechanism according to claim 11, wherein said biasing means comprise a coil spring.

14. A mechanism according to claim 13 wherein said coil spring bears against an inner face of said piston crown and an adjacent face of said bobbin.

15. A mechanism according to claim 13 wherein said coil spring bears against an abutment towards the end of said piston remote from the piston crown and adjacent face of the bobbin.

16. A mechanism according to claim 1 wherein said means for urging said piston towards said discharge port is a coil spring.

17. A mechanism according to claim 1 wherein said mass is located within an enclosed space within said piston.

18. A mechanism according to claim 17 wherein said mass consists of a bobbin.

19. An air weapon comprising a firing mechanism as claimed in claim 1.

* * * * *